US006153863A

United States Patent [19]

Snowball

[11] Patent Number: 6,153,863

[45] Date of Patent: Nov. 28, 2000

[54] INDUCTION HEATING APPARATUS

[75] Inventor: Malcolm Robert Snowball, Epping, United Kingdom

[73] Assignee: Induced Energy Limited, Bicester, United Kingdom

[21] Appl. No.: 09/341,808

[22] PCT Filed: Jan. 9, 1998

[86] PCT No.: PCT/GB98/00064

§ 371 Date: Jul. 19, 1999

§ 102(e) Date: Jul. 19, 1999

[87] PCT Pub. No.: WO98/32310

PCT Pub. Date: Jul. 23, 1998

[30] Foreign Application Priority Data

Jan. 20, 1997 [GB] United Kingdom ..... 9701066

[51] Int. Cl.[7] ..... H05B 6/08; H05B 6/12

[52] U.S. Cl. ..... 219/626; 219/670; 219/665; 219/666

[58] Field of Search ..... 219/625, 626, 219/627, 624, 661, 662, 665, 666, 667, 672, 675, 670

[56] References Cited

U.S. PATENT DOCUMENTS

| | | | |
|---|---|---|---|
| 4,426,564 | 1/1984 | Steigerwald et al. | 219/625 |
| 4,820,891 | 4/1989 | Tanaka et al. | 219/627 |
| 4,886,952 | 12/1989 | Horiuchi | 219/661 |
| 5,191,302 | 3/1993 | Rossinick | 219/665 |

FOREIGN PATENT DOCUMENTS

| | | |
|---|---|---|
| 0717581 | 6/1996 | European Pat. Off. . |
| 7340497 | 7/1974 | France . |
| 2183941 | 6/1987 | United Kingdom . |
| WO9304527 | 3/1993 | WIPO . |

*Primary Examiner*—Philip H. Leung

*Attorney, Agent, or Firm*—Vedder, Price, Kaufman & Kammholz

[57] ABSTRACT

An induction heating or cooking apparatus comprises an inductive heating coil (L), means (CT) for sensing the current $I_s$ of an AC supply applied to the heating coil (L), means (VR) for selecting the desired heat output of the apparatus, means (APC) for comparing the sensed current with in output of the selecting means (VR), and means (RL1) for varying a the voltage of the supply to the heating coil (L) in accordance with the value of an error signal output from the comparing means (APC). Thus, the temperature which the base of a cooking utensil (P) stood on the coil (L) reaches is independent of the material of the utensil.

2 Claims, 4 Drawing Sheets

INDUCTION HEATING APPARATUS

BACKGROUND OF THE INVENTION

This invention relates to induction heating apparatus.

Cooking hobs are known which comprise one or more large induction coils, on which pans having an electrically inductive base can be stood. In use, a high frequency signal (in excess of 20 kHz) is applied to the coil, which generates a magnetic field that induces eddy currents in the pan base. The base of the pan is not an ideal conductor, and thus the electrical energy is dissipated as heat as current flows through the pan base. Thus, the heating effect is proportional to $I^2R$, where I is the current in the base of the pan and R is the electrical resistance of the pan.

The resistivity of the pan base depends on the material that it is made from. Thus, it will be appreciated that the temperature which the pan base reaches will be dependent on the material of the pan, with the obvious disadvantage that discrepancies will occur between the heat setting, which has been selected by the user, and the actual heat developed.

SUMMARY OF THE INVENTION

We have now devised an inductive heating apparatus which alleviates the above-mentioned problem.

In accordance with this invention, there is provided an induction heating apparatus comprising an inductive heating coil, means for sensing the current and/or voltage value of an a.c. supply applied to the heating coil, means for selecting the desired heat output of the apparatus, means for comparing the sensed current and/or voltage value with an output of the selecting means, and means for varying a parameter of the supply to the heating coil in accordance with the value of an error signal output from the comparing means.

In use, we have found that the heating coil of an inductive heating apparatus acts rather like the primary winding of a transformer with the pan acting as a single shorted turn secondary winding. The heating effect in the base of the pan is proportional to $I^2R$, where I is the current in the base of the pan and R is the electrical resistance. The heating effect in the base of the pan is also dependent on the depth of penetration of the magnetic field into the base, and this depth of penetration is inversely proportional to the coil frequency. Thus, it will be appreciated that the heating effect at a given frequency can be determined by measuring the current and/or voltage at the coil primary, and that the heating effect can thus be varied by varying the current, voltage or frequency value applied to the coil.

In one embodiment, the varying means is arranged to vary the drive frequency which is applied to the coil, in order to vary the depth of the penetration of the magnetic field into the pan base, so that the heating effect is correspondingly varied.

Preferably the heating coil forms part of a tuned circuit, which is preferably arranged to oscillate at its resonant frequency, in order to maximise the voltage across the coil, and hence maximise its efficiency.

Preferably the resonant frequency of the heating coil is varied as the drive frequency is varied, by varying the impedance of the coil and/or by varying the capacitance of the tuned circuit.

Preferably the impedance and/or capacitance is varied by respectively switching inductors and capacitors into or out of the tuned circuit.

A disadvantage of varying the operating frequency of the coil is that beating or heterodyning can occur if there is more than one heating coil in an inductive heating apparatus. This beating or heterodyning occurs when the coils operate at a different frequency, thereby causing a third frequency of a value which is equal to the difference in the coil frequencies. Often, this frequency will be less than 16 kHz, with the result that it is audible and annoying to users.

Thus, it is preferable that the coil operates at a fixed frequency in order to avoid the problems of heterodyning.

Thus, in an alternative embodiment the varying means is arranged to vary the value of the current applied to the coil by varying its number of turns, and from this it will be appreciated that a different voltage and current are induced in the secondary, with a correspondingly different heating effect.

A disadvantage of varying the number of turns of the coil is that the resonant frequency varies. Thus, in order to compensate for this the varying means is preferably arranged to increase the capacitance of the tuned circuit when the number of turns of the coil is reduced and vice-versa, so that the multiple of the inductance and capacitance of the tuned circuit remains the same, thereby keeping the resonant frequency constant.

In an alternative preferred embodiment, the varying means is preferably arranged to vary the voltage applied to the coil, in order to correspondingly vary the voltage induced in the pan or other cooking utensil.

The voltage applied to the coil can only be varied within the constraints of the supply voltage, and thus the heating coil is preferably connected across the secondary of a transformer, the varying means being arranged to vary the voltage across the coil by varying the number of turns of the transformer primary or secondary.

Preferably the heating coil forms a part of a tuned circuit, which is preferably arranged to oscillate at its resonant frequency. Thus, the varying means is preferably only arranged to vary the number of turns of the transformer primary, because a variation in the number of turns on the secondary would affect the resonant frequency of the tuned circuit connected thereto.

These and other objects, features and advantages of the present invention will be clearly understood through consideration of the following detailed description.

BRIEF DESCRIPTION OF THE DRAWINGS

The varying means may also be arranged to vary the voltage across the coil by varying the value of the supply to the transformer primary.

Embodiments of this invention will now be described by way of examples only and with reference to the accompanying drawings, in which.

DETAILED DESCRIPTION OF THE PREFERRED EMBODIMENTS

Figure 1:
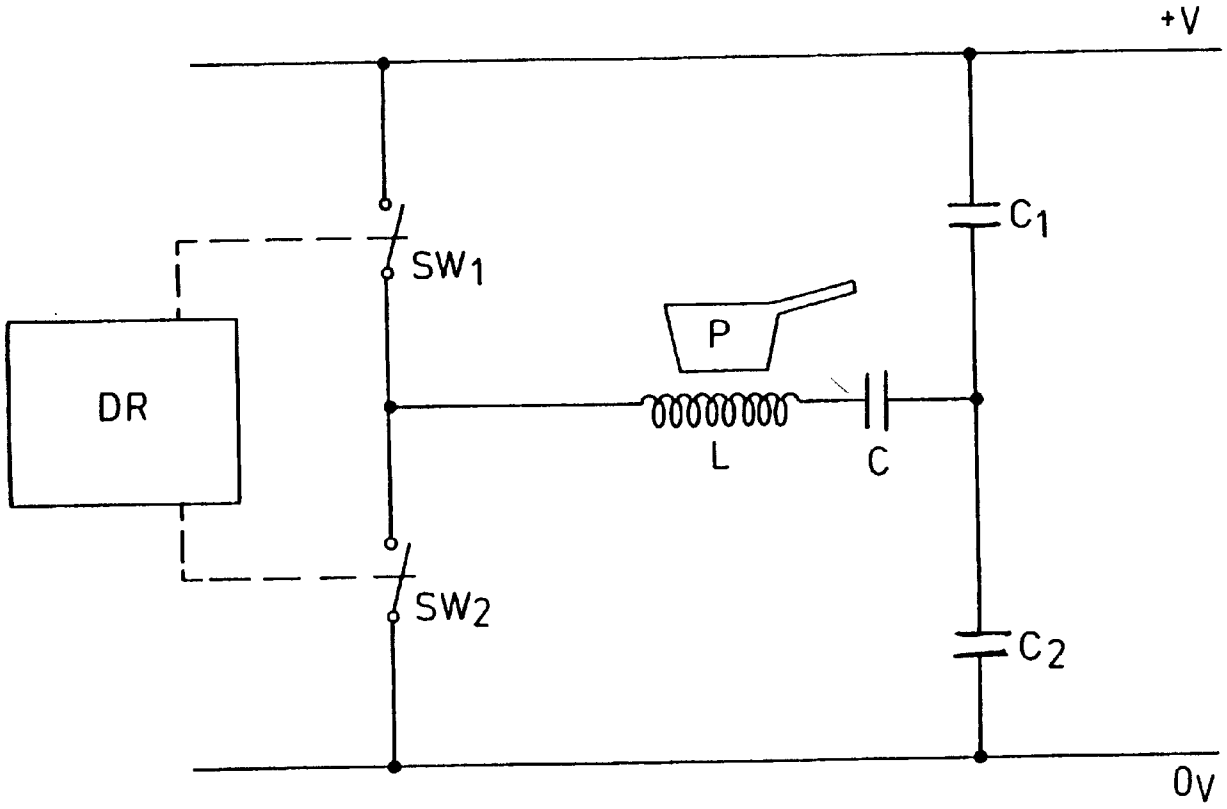
FIG. 1 PRIOR ART
FIG. 1 is a schematic diagram of a conventional induction heating apparatus.

Referring to FIG. 1 of the drawings, there is shown a conventional induction heating apparatus comprising a pair of high frequency power transistors SW1,SW2 connected in series across the supply. A pair of capacitors C1,C2 are also connected in series across the supply.

An inductive heating coil L and a capacitor C are connected in series between two points which are respectively disposed at the connection point between the transistors SW1,SW2 and at the connection point between the capacitors C1,C2. The transistors SW1,SW2 are controlled by a high frequency driver circuit DR.

In use, a pan P is stood on the inductive heating coil L and the heating apparatus is energised. Initially C is discharged, however, when SW1 is closed C and C2 are charged from the supply through L. When C is fully charged SW1 opens and SW2 closes, whereupon C discharges through L and C1. This cycle is repeated continuously, thereby providing an alternating magnetic field in induction heating coil L.

SW1 and SW2 are switched at or near the resonant frequency of the tuned circuit LC, so that losses are kept to a minimum. The resonant frequency of the tuned circuit LC is defined as $$f=1/(2\times\pi\times\sqrt{(L\times C)})$$

A disadvantage of this arrangement is that the heating effect in the pan P is proportional to $I^2R$, where R is the electrical resistance of the pan base and I is the current flowing through the base. Thus, it will be appreciated if the temperature control dial is set to provide a predetermined current and/or voltage to the coil, then the temperature produced will actually depend on the material of the pan base.

Figure 2:
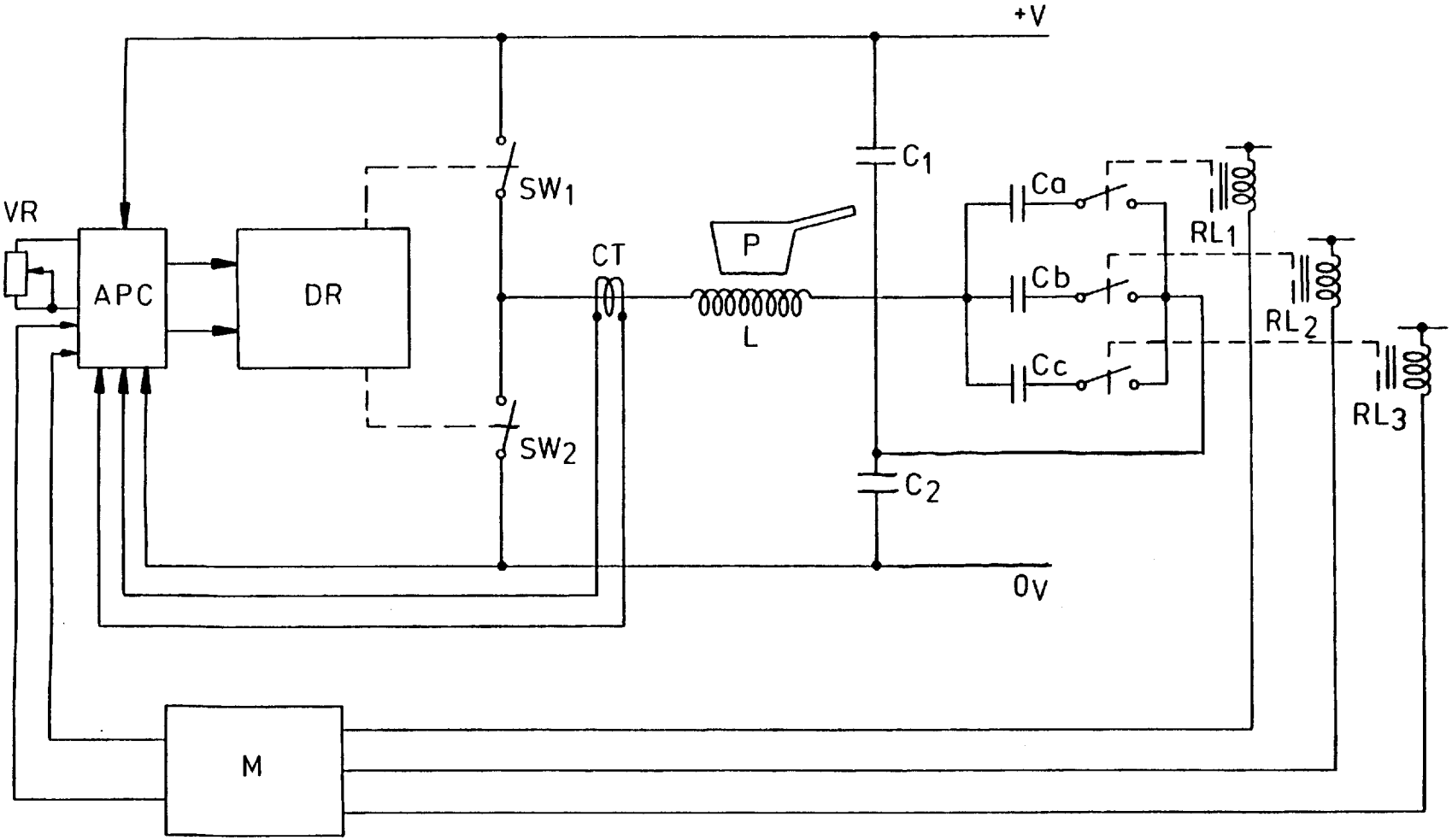
FIG. 2 is a schematic diagram of a first embodiment of induction heating apparatus in accordance with this invention.

In order to overcome this problem, the conventional circuit can be modified in accordance with this invention, as shown in FIG. 2 of the drawings. The arrangement of the circuit of FIG. 2 is similar to that of FIG. 1, and like parts are given like reference numerals. The main difference between the two circuits is that the capacitor of the tuned circuit is replaced by a bank of capacitors $C_a$,$C_b$,$C_c$ connected in parallel. Each of the capacitors $C_a$,$C_b$,$C_c$, is connected in series with the switched contacts of respective relays RL1,RL2,RL3. A current sensing coil CT monitors the current flowing through the heating coil L.

A potentiometer VR for selecting the heat setting of the hob is connected to an automatic power control circuit APC, which controls the transistor driver circuit DR. The power control circuit APC either measures the voltage or current from the potentiometer VR, in order to determine the desired heat setting. The current sensing coil is connected to the power control circuit APC. The energising coils of the relays RL1,RL2,RL3 are connected between the positive supply and a microprocessor M, which is controlled by the power control circuit APC.

The circuit operates in the same way as the circuit of FIG. 1, with the capacitors $C_a$,$C_b$,$C_c$, charging and discharging through the coil L at a frequency near resonance.

The power control circuit APC receives a voltage from the current transformer CT, which is proportional to the voltage across the coil L. The coil L acts as the primary of a transformer, with the pan acting as a single, shorted turn secondary winding. The voltage $V_2$ across this singled shorted turn secondary winding is equal to the voltage $V_1$ across the primary (i.e. coil L) multiplied by the turns ratio ($N_2/N_1$) of the effective transformer. The voltage $V_2$ across the secondary is proportional to the heating effect in the pan base, and thus it will be appreciated that the output of the current sensing coil CT also is proportional to the heating effect.

The power control circuit APC compares the output of the current sensing coil CT with the power setting selected by potentiometer VR, and produces an error signal. This error signal is fed to the microprocessor M, which determines whether the drive frequency needs to be adjusted, since an increase in frequency will produce a decrease in current penetration in the pan base, and a corresponding lower heating effect, and vice-versa.

The resonant frequency is controlled by switching selected capacitors $C_a$,$C_b$,$C_c$ in the capacitor bank into or out of the tuned circuit using the relays RL1,RL2,RL3.

A disadvantage of this system is that a large number of capacitors are required in the capacitor bank if a fine control of the frequency, and hence of the power, is to be provided.

Another disadvantage is that in hobs having two coils, each coil will be running at a different frequency, with the result that their frequencies will interact or heterodyne, thereby producing an audible whine at a frequency which is equal to the difference between the two coil frequencies. This audible whine will constitute a nuisance to the equipment operator.

Figure 3:
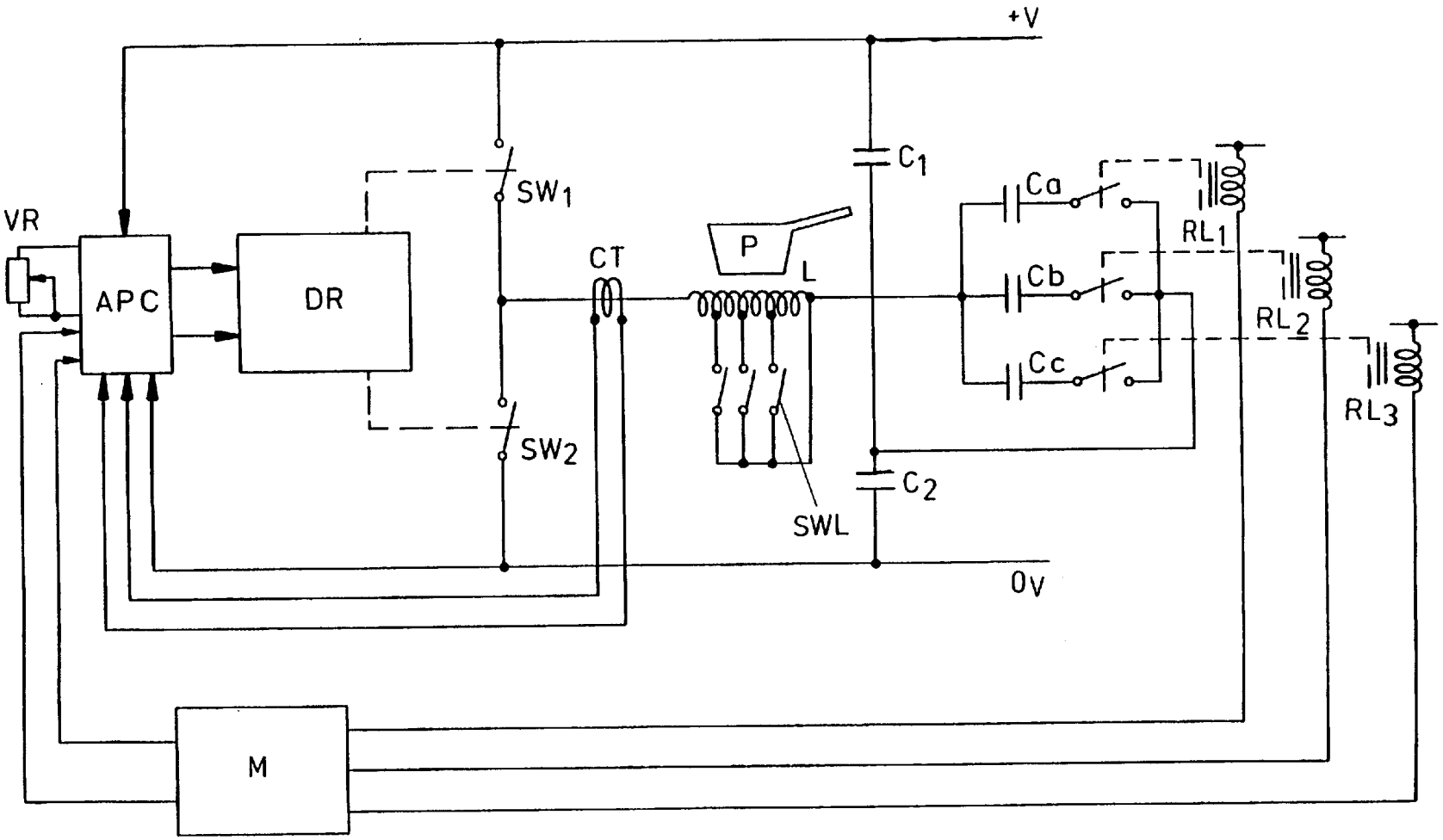
FIG. 3 is a schematic diagram of a second embodiment of induction heating apparatus in accordance with this invention.

Referring to FIG. 3 of the drawings, there is shown an alternative embodiment of induction heating apparatus, and like parts are given like reference numerals. In this embodiment, the heating coil L comprises a number of taps on its windings which are respectively connected to one side of the coil L through respective switches e.g. SWL.

It will be appreciated from the formula $V_2=V_1\times N_2/N_1$ that the effective voltage $V_2$ developed across the pan base is dependent upon the ratio $N_2/N_1$ of the windings. Thus, the heating effect developed in the pan P can be varied by switching selected switches e.g. SWL, so as to vary the number turns $N_1$ on the coil L.

A disadvantage of this arrangement is that the impedance of the coil L changes as its turns are varied, which affects the resonant frequency of the tuned circuit. However, this disadvantage can be overcome by switching capacitors $C_a$,$C_b$, $C_c$ in the capacitor bank into circuit as the turns of the coil L are shorted, and vice-versa.

Thus, the circuit of FIG. 3 can be operated at a fixed frequency close to its resonant frequency. However, the circuit still suffers from the drawback that a large number of capacitors are required in the capacitor bank to achieve fine control. Similarly, a large number of coil trappings are also required.

Figure 4:
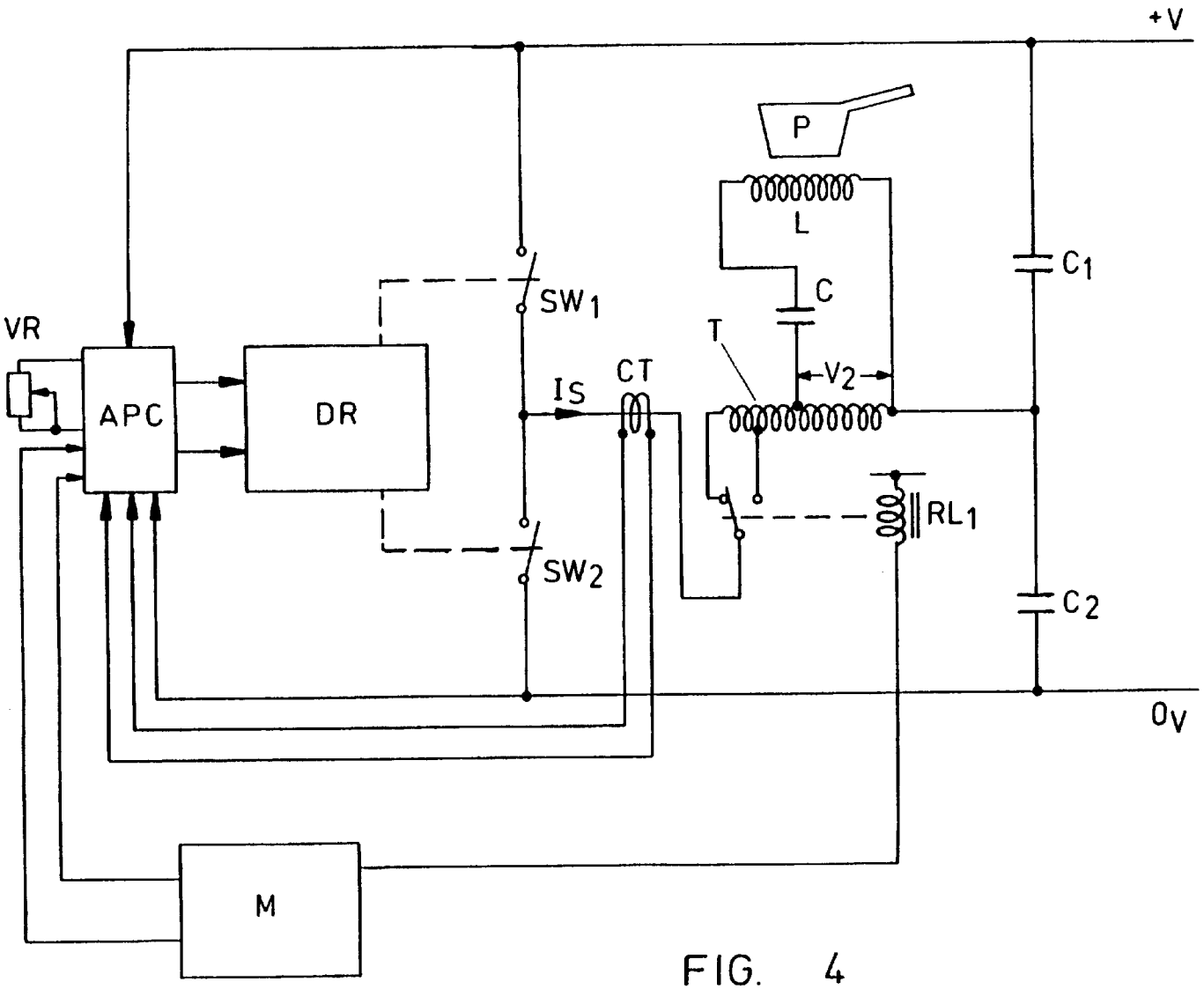
FIG. 4 is a schematic diagram of a third embodiment of induction heating apparatus in accordance with this invention.

Referring to FIG. 4 of the drawings, there is shown a preferred embodiment of induction heating apparatus and like parts are given like reference numerals. In this embodiment, a so-called auto-transformer is connected in place of the coil L. An auto-transformer is a transformer in which the secondary winding comprises a tapped section of the primary winding. The heating coil L is connected in series with a capacitor across the secondary winding of the auto-transformer T.

The voltage $V_2$ across the secondary of the auto-transformer T is proportional to the voltage $V_1$ across its primary times its turns ratio.

When current flows through the auto-transformer T it also flows through the heating coil L and the capacitor C, which are connected across the secondary windings. When the capacitor C is fully charged SW1 opens and SW2 closes, so that C discharges through the heating coil L and through the auto-transformer. It will be appreciated that at this point the current is flowing in the reverse direction through the heating coil L. SW1 and SW2 are controlled so that the cycle repeats at the resonant frequency of the heating coil L and capacitor C.

The automatic power control circuit APC indirectly senses the current $I_s$ flowing through the heating coil L, by sensing the current flowing through the primary winding of the auto-transformer T. The power control circuit APC compares the sensed current with the setting produced by the potentiometer VR and produces an output error signal, which is fed to the microprocessor M. If the error signal is demanding more power, i.e. the signal magnitude at the potentiometer VR is larger than the signal magnitude from the current sensing coil CT, the power control circuit APC automatically increases the voltage on the supply rail +V until both signals are equal It will be appreciated that the voltage $V_1$ across the primary of the auto-transformer T will rise if the supply is raised, and that correspondingly more voltage will be developed across the coil L, thereby increasing the power delivered to the pan base.

If the power control circuit APC raises the supply voltage to a maximum and still cannot get enough power into the pan, the microprocessor M detects that not enough power is achieved and switches a relay RL1, which effectively reduces the number of turns N1 on the primary of the auto-transformer T, so that the voltage $V_2$ on the secondary increases according to the formula $$V_2=V_1\times N_2/N_1.$$

The resistance of the base of the pan remains constant as does the frequency of operation and depth of penetration into the pan base. Thus, the power into the base increases as the secondary voltage $V_2$ increases. This technique solves the pan-to-pan power variations very economically because only one relay is needed and no coil retuning is required.

The auto-transformer coil T automatically matches the impedance of the tuned circuit LC to the switching circuit, so that the power switches always switch within a known band of current values, irrespective of the type of pan material. This means that less expensive power switches can be used.

The switching current is transformed by the auto-transformer into the tuned circuit LC by the factor $N_1/N_2$, and hence there is a higher current through the coil L than conventional systems, with a correspondingly higher depth of magnetic field penetration into the pan base.

The power to the pan is not varied by varying the frequency and thus the problem of beating or heterodyning is avoided. While the preferred embodiment of the invention have been shown and described, it will be apparent to those skilled in the art that changes and modifications may be made therein without de-Darting from the spirit of the invention, the scope of which is defined by the appended claims.

What is claimed is:

1. An induction heating apparatus comprising:

an auto-transformer;

an inductive heating coil and a capacitance connected together to form a tuned circuit arranged to oscillate at a fixed frequency, the tuned circuit being connected across a secondary tapping of a winding of the auto-transformer;

means for sensing one of a current value and voltage value of a power supply connected across the auto-transformer;

means for selecting a desired heat output of the apparatus;

means for comparing the sensed current or voltage value to a heat output selected with the selecting means;

and means for varying the voltage of the supply to the inductive heating coil, in accordance with the value of an error signal output from the comparing means, by varying the number of turns of the winding of the auto-transformer, across which a supply voltage is applied.

2. An induction heating apparatus as claimed in claim 1, in which the varying means is also arranged to vary the voltage value of the supply to the auto-transformer.

* * * * *